United States Patent [19]

Schenker et al.

[11] Patent Number: 5,045,134

[45] Date of Patent: Sep. 3, 1991

[54] METHOD FOR SPLICING TRAILING AND LEADING ENDS OF SHEETS

[75] Inventors: Thomas Schenker, Neuhausen am Rheinfall, Switzerland; Horst Loewenthal, Tiengen, Fed. Rep. of Germany

[73] Assignee: Sig Schweizerische Industrie-Gesellschaft, Neuhausen am Rheinfall, Switzerland

[21] Appl. No.: 422,804

[22] Filed: Oct. 17, 1989

[30] Foreign Application Priority Data

Oct. 17, 1988 [CH] Switzerland ..... 3867/88

[51] Int. Cl.[5] ..... B65H 19/00; B32B 31/00

[52] U.S. Cl. ..... 156/64; 156/157; 156/350; 156/351; 156/361; 156/502; 156/504; 226/11; 226/24; 226/43; 226/119; 226/122

[58] Field of Search ..... 156/350, 351, 502, 504, 156/353, 361, 349, 157, 159, 64; 226/11, 14, 24, 122, 43, 44, 118, 119

[56] References Cited

U.S. PATENT DOCUMENTS

| | | | |
|---|---|---|---|
| 3,727,820 | 4/1973 | Braun | 226/118 X |
| 3,865,296 | 2/1975 | Alverson | 226/119 X |
| 4,060,186 | 11/1977 | Nabhan | 226/118 X |
| 4,100,012 | 7/1978 | Meihofer et al. | 156/504 X |
| 4,131,501 | 12/1978 | Bottcher et al. | 156/504 X |
| 4,771,621 | 9/1988 | Sato | 226/24 X |
| 4,785,902 | 1/1974 | Preston et al. | 156/504 X |

*Primary Examiner*—David A. Simmons
*Assistant Examiner*—J. Sells
*Attorney, Agent, or Firm*—Spencer & Frank

[57] ABSTRACT

A splicing apparatus for joining a trailing end of a first sheet to a leading end of a second sheet comprises a first servomechanism including a first drive for engaging and advancing the first sheet in a direction of advance; a second servomechanism including a second drive for engaging the first sheet upstream of the first drive; a splicing device for joining the trailing and leading ends to one another upstream of the second drive; a sensor for generating a signal when the trailing end of the first sheet passes a predetermined location upstream of the splicing device; and a computer connected to the first and second servomechanisms, the splicing device and the sensor for reducing the speed of the advancing first sheet and for subsequently effecting a joining operation of the splicing device upon receiving the signal from the sensor; and a sheet length compensating device engaging the first sheet at a location between the first and second drive for reducing or increasing the length of the first sheet between the first and second drive upon variations of speed between the first and second drive.

5 Claims, 4 Drawing Sheets

METHOD FOR SPLICING TRAILING AND LEADING ENDS OF SHEETS

CROSS REFERENCE TO RELATED APPLICATION

This application claims the priority of Swiss Application No. 3867/88-8 filed Oct. 17th, 1988, which is incorporated herein by reference.

BACKGROUND OF THE INVENTION

This invention relates to a method of and an apparatus for connecting the trailing end of a first sheet with the leading end of a second sheet and is of the type which has a drive for advancing the first sheet taken from a first supply reel and also has a second supply reel for supporting the second sheet.

An apparatus of the above-outlined type is used, for example, in packing machines to splice the trailing end of a wrapper sheet pulled from a supply reel to the leading end of a wrapper sheet taken from a second supply reel while observing predetermined distances of centering marks provided on the wrapper sheets.

SUMMARY OF THE INVENTION

It is an object of the invention to provide an improved apparatus and method to make possible an accurately centered splicing of the sheet ends even at high running speeds.

This object and others to become apparent as the specification progresses, are accomplished by the invention, according to which, briefly stated, the splicing apparatus for joining a trailing end of a first sheet to a leading end of a second sheet comprises a first servomechanism including a first drive for engaging and advancing the first sheet in a direction of advance; a second servomechanism including a second drive for engaging the first sheet upstream of the first drive; a splicing device for joining the trailing and leading ends to one another upstream of the second drive; a sensor for generating a signal when the trailing end of the first sheet passes a predetermined location upstream of the splicing device; and a computer connected to the first and second servomechanisms, the splicing device and the sensor for reducing the speed of the advancing first sheet and for subsequently effecting a joining operation of the splicing device upon receiving the signal from the sensor; and a sheet length compensating device engaging the first sheet at a location between the first and second drive for reducing or increasing the length of the first sheet between the first and second drive upon variations of speed between the first and second drive.

DESCRIPTION OF THE PREFERRED EMBODIMENTS

Figure 1:
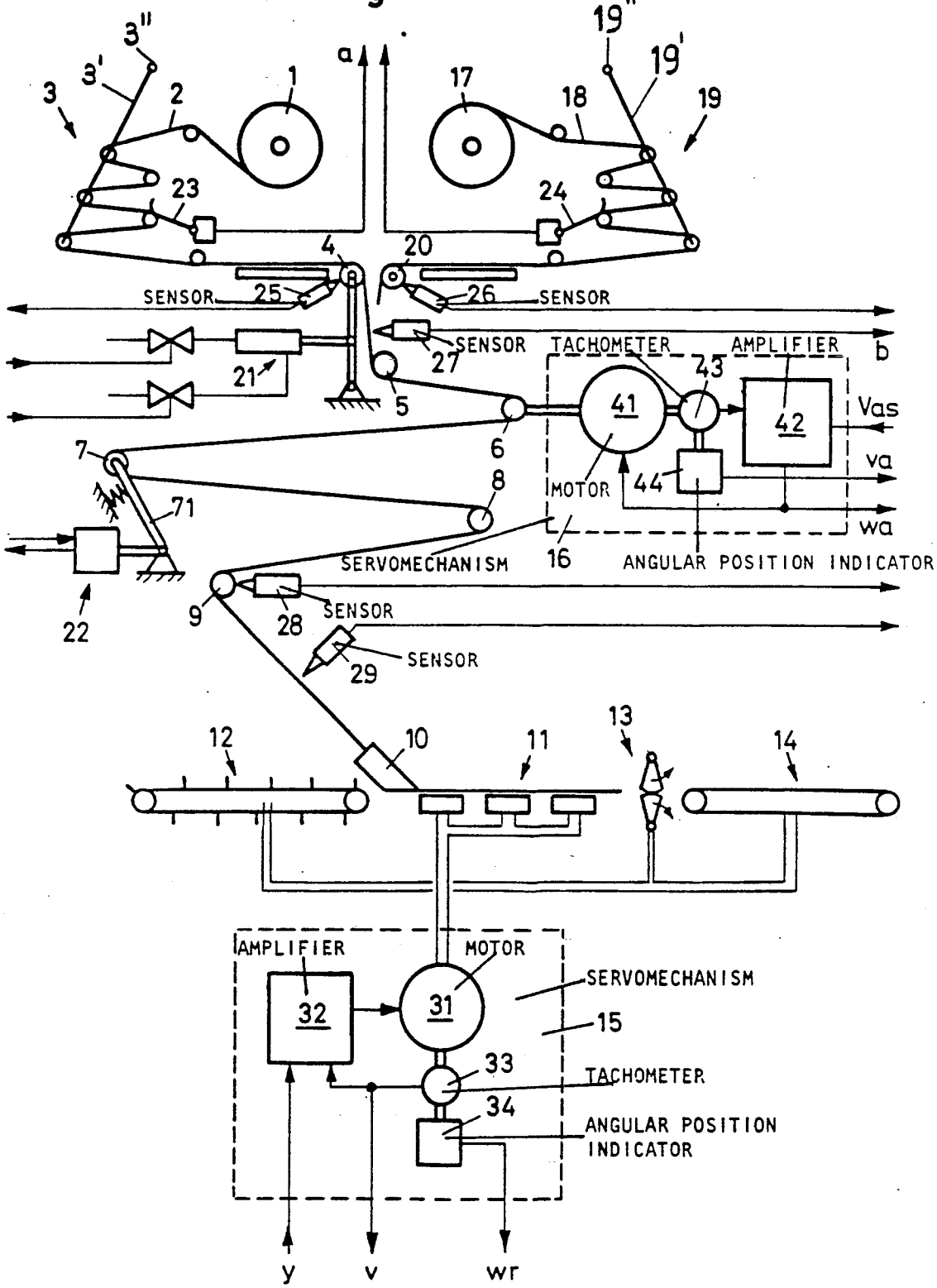
FIG. 1 is a schematic elevational view of a packing machine incorporating an apparatus according to the invention.

Turning to FIG. 1, the packing machine shown therein has a first supply reel 1 from which a sheet (wrapper film) 2 is taken off and trained about a roller assembly 3, a splicing roller 4, a guide roller 5, a drive roller 6, a sheet length compensating roller 7 and two further guide rollers 8 and 9. Thereafter, the sheet 2 is introduced into a folder box 10 which forms a tube from the sheet. The tube is pulled from the folder box 10 by a feed roller assembly 11. Upstream of the folder box 10, as viewed in the direction of sheet advance, there is situated a loading device 12 which introduces the goods to be packaged into the sheet material tube which, at uniform distances, is pinched together and sealed by a transverse heat sealing device 13 adjoined downstream by a removal device 14 which further transports the closed packages.

The feed roller assembly 11 is driven by a motor 31 of a first servomechanism 15, while the drive roller 6 is driven by a motor 41 of a second servomechanism 16. The servomechanisms 15 and 16 are connected to a computer, not shown. The two servomechanisms may be of identical construction and each may have a respective amplifier 32, 42, a tachometer 33, 43 and an angular position indicator 34, 44.

The packing machine shown in FIG. 1 is further provided with a second supply reel 17 from which a wrapper sheet 18 may be taken through a roller assembly 19 as soon as the supply reel 1 is empty. To ensure continuity of the running wrapper sheet, a splicing device 21 is provided which presses the splicing rollers 4 and 20 against one another in order to connect the trailing end of the sheet 2 with the leading end of the sheet 18. Further, the sheet storing roller 7 is movably integrated in a device 22 by means of a pivotal lever 71 for the purpose of varying the length of the sheet loop between rollers 6 and 8. Further, sensors 23–29 are provided for the various control and monitoring tasks. Expediently, the sensors 23–29 are optical sensors. The sensors 25 and 26 are provided to indicate which of the supply reels 1 or 17 rotates.

The sheets 2 and 18 are trained about the plurality of rollers of the roller assemblies 3 and 19 in a zigzag fashion. Both roller assemblies 3 and 19 are sheet length compensating arrangements. For this purpose, alternating rollers are secured to a respective support bar 3' and 19' pivotal about respective articulations 3'' and 19''.

Figure 2:
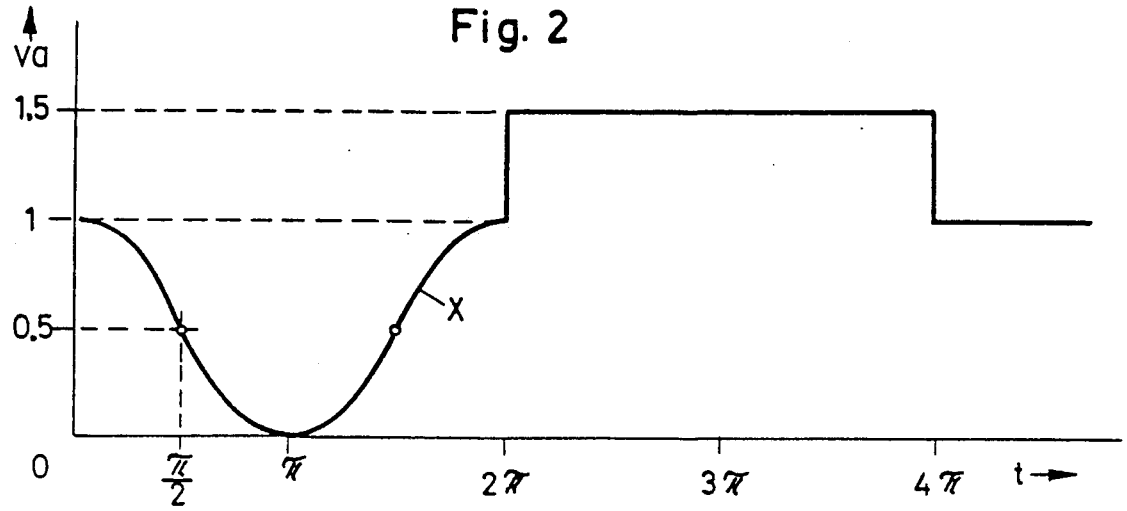
FIG. 2 is a diagram illustrating a first variant of the speed/time curve of a motor incorporated in the apparatus according to the invention.

The packing machine illustrated in FIG. 1 operates as follows:

The sheet end sensor 23 responds when the trailing end of the sheet 2 passes through a predetermined location of the roller system 3 and, accordingly, delivers a signal a to the computer which, based on the signal and other parameters, generates a control signal Vas for the servomechanism 16 to change the speed v of the motor 41 in accordance with the function va(t) illustrated in FIG. 2. Between the normalized time 0 and $\pi$ the velocity v(t)=x is reduced from x=1 to x=0 so that at the instant $\pi$ the sheet 2 is, for a moment, stationary in the zone of the splicing rollers 4 and 20 to facilitate a connection or bonding of the trailing end of the sheet 2 with the leading end of the sheet 18. Thereafter, the velocity x is increased to obtain, for example, at the moment $2\pi$, again the normalized velocity x=1. In this manner there is obtained a path difference L between the travelled paths of the sheet in the portion upstream and downstream of the drive roller 6 since the lower (downstream) portion of the sheet continues its travel with the constant normalized velocity v=1. The path difference L is absorbed by the movable length compensating roller 7 because by virtue of the motion of the pivotal lever 71 the length of the lower sheet portion, that is, the sheet portion between the drive roller 6 and the movable roller 7 will be shortened by the extent L during the time period 0 to $2\pi$ (FIG. 2). After the moment $t=2\pi$ the velocity va of the drive roller 6 may be increased for example, to va=1.5 for a further time period $T=2\pi$ in order to compensate for the path difference L and to lengthen the lower sheet portion by the amount L in such a manner that at the moment $t=4\pi$ both sheet portions, that is, the sheet portions upstream and downstream of the drive roller 6, are running with the same normalized velocity va=1.

Figure 3:
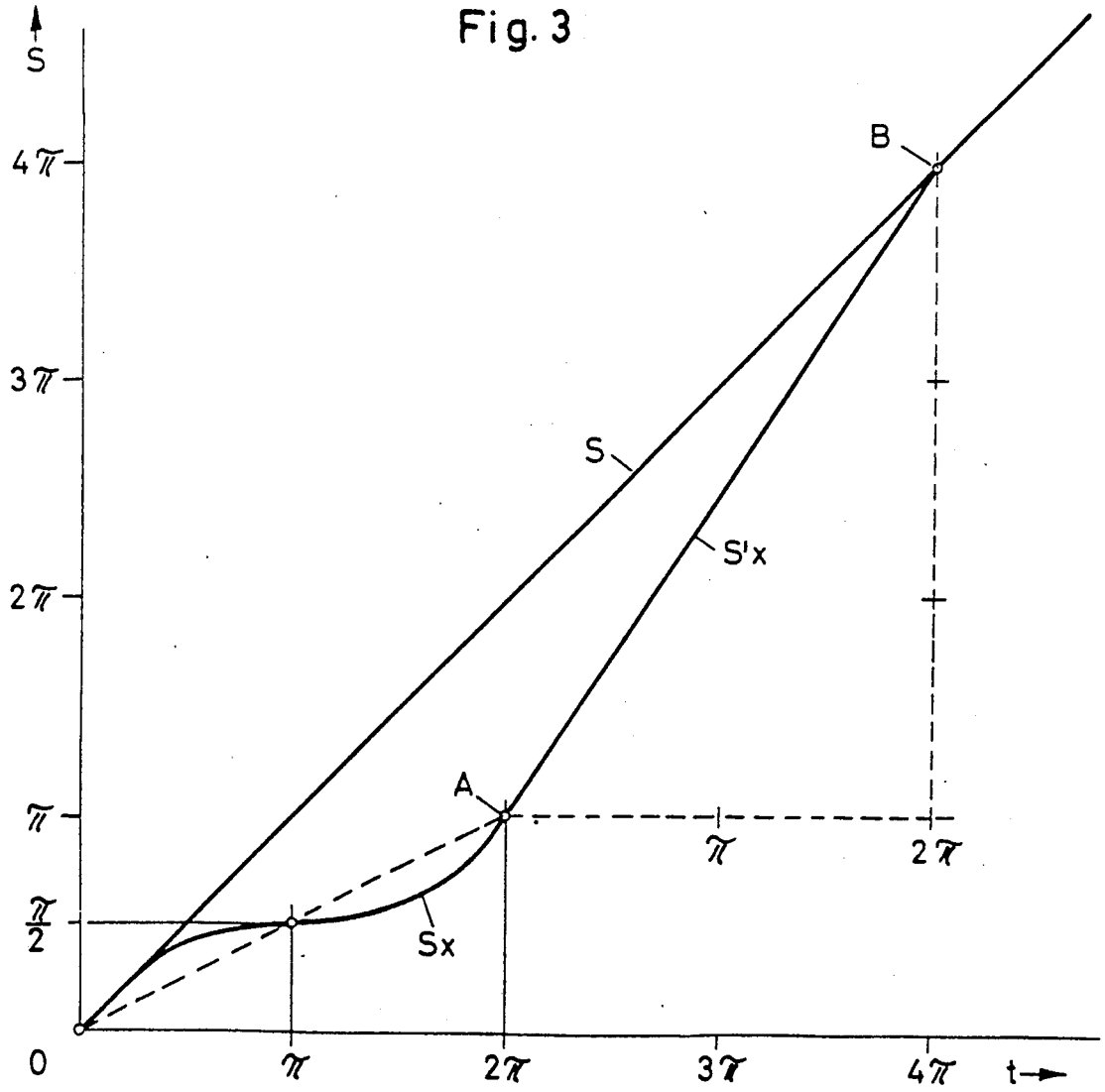
FIG. 3 is a diagram illustrating length/time curves pertaining to a sheet loop in a buffer device (length compensating device) taking into account the different sheet velocities upstream and downstream of the buffer device.

Turning to FIG. 3, the straight line S designates a path travelled by the lower portion of the sheet 2 wherein, because of the normalization, S=t. In the normal case the velocities of the two parts of the sheet are the same. During splicing the velocity va=x of the upper sheet part is reduced in such manner that its travel path is Sx. FIG. 3 illustrates the constancy (zero slope) of the function Sx(t) at the point $t=\pi$, corresponding to the achieved standstill of the sheet.

As an example, it is assumed that $$x=(1+\cos t)/2=va(t)$$

is the normalized velocity (FIG. 2). For the length Sx there is obtained by integration $$Sx=\int x\cdot dt=\int(1+\cos t)/2\cdot dt=0.5\cdot t+0.5\cdot\sin t$$

which is valid for the range from 0 to $2\pi$.

For $t=2\pi$ there is obtained $Sx=\pi$ (point A in FIG. 3).

Assuming in the zone $2\pi$ through $4\pi$ the function $v\doteq 1.5$ (constant), there is obtained for the length Sx by integration $$S'x=\int 1.5\cdot dt=1.5t$$

so that for $t=4\pi$ there is obtained $S'x=3\pi$ (point B).

It is to be understood that for the velocity v entirely different functions may be selected which would effect a standstill of the sheet for a short period of time.

It is further to be noted that due to $$\int_0^{2\pi}(1-x)dt=0.5\cdot\int(1-\cos t)dt=\pi$$

the surfaces F1 and F2 in FIG. 2 are identical, that is, F1=F2.

Figure 4:
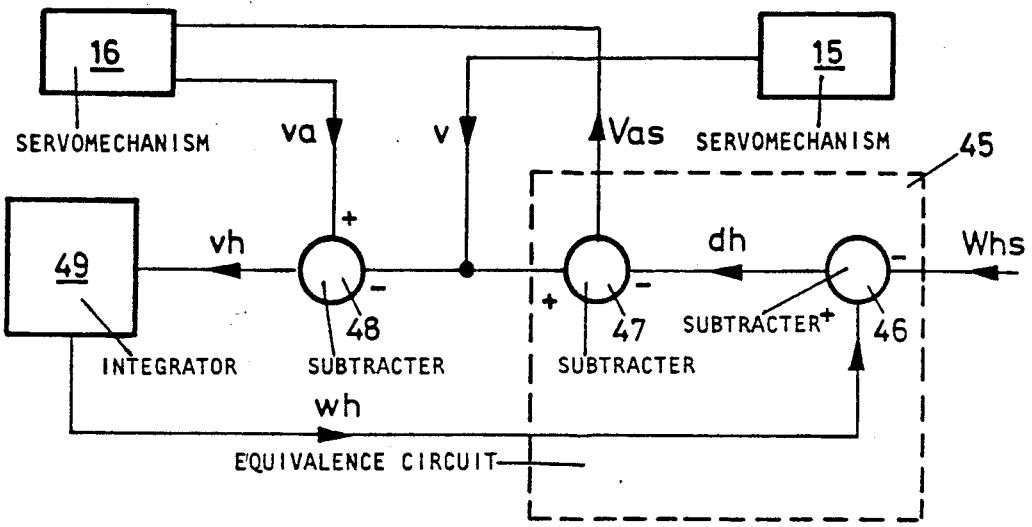
FIG. 4 is an equivalence circuit diagram of a computer for a normal operation of servomechanisms of the apparatus according to the invention.

FIG. 4 illustrates the equivalence circuit diagram 45 for the computer for the normal operation of the servomechanisms 15 (master) and 16 (slave). The letter symbols in FIG. 4 have the following meaning:

Whs=the desired shift of the pivotal lever 71 of the device 22 (or, stated differently, Whs=the desired length increase of the sheet between the two servomechanisms 15 and 16), v=the actual velocity of the sheet at the feed roller assembly 11, va=the actual velocity of the sheet at the drive roller 6 (FIG. 1), vh=the equivalent actual velocity component of the sheet upon angular changes of the pivotal lever 71, wh=the actual shift of the pivotal lever 71 and Vas=the desired velocity of the sheet at the drive roller 6.

The computer effects the performance of the following functions:

The output signal v of the servomechanism 15 is applied to a subtracter 47 which forms the difference $Vas=v-p\cdot dh$, wherein p is a parameter and dh is the output signal of a further subtracter 46 in which the difference $dh=wh-Whs$ is formed.

The signal wh is delivered by an integrator 49 having an input to which there is applied the output signal $vh=va-v$ of a further subtracter 48 which receives the signal va from the slave servomechanism 16 which, in turn, is controlled by the signal Vas.

Thus, there applies $$Vas=q\cdot\int(va-v)dt-v+p\cdot Whs.$$

The above equation shows that a standstill of the drive 41 (and the associated drive roller 6) is possible because for Vas=0 the machine is capable of continuing its operation even if v is different from 0. In this equation p and q are experimentally determined parameters having a dimension $s^{-1}$.

Figure 5:
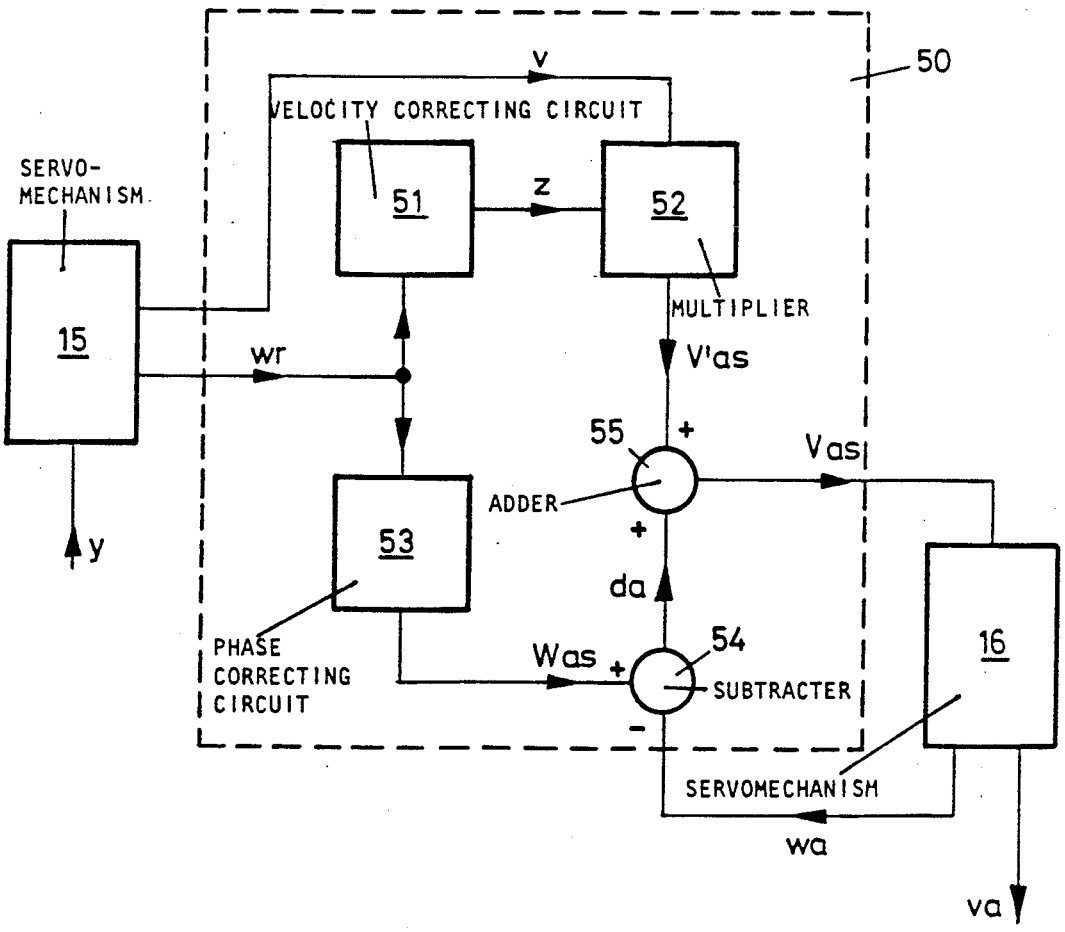
FIG. 5 is an equivalence circuit diagram of the computer for a special operation of servomechanisms of the apparatus during the period when splicing of the sheets is performed.

Turning to FIG. 5 there is shown therein the equivalence circuit diagram 50 of a computer for the particular case of velocity reduction for the splicing process. The additional letter symbols used in FIG. 5 have the following meaning:

Was=the desired angle of the motor 41, wa=the actual angle of the motor 41 and wr=the actual angle of the motor 31.

The computer causes the performance of the following functions:

The output signal wr of the servomechanism 15 is applied to a velocity correcting circuit 51 and a phase correcting circuit 53 whose output signal Was is applied to a subtracter 54 in order to form the difference $da=-Was-wa$, wherein wa is delivered by the servomechanism 16. In an adder 55 the sum of the signal da and the output signal V'as of a multiplier 52 is formed. In the multiplier 52 a multiplication of an output signal z of the velocity correcting circuit 51 and an output signal v of the servomechanism 15 is carried out. The output signal Vas of the adder 55 is applied to the servomechanism 16 which also delivers the signal va.

Thus, the equation $$Vas=Was-wa+v\cdot z$$

applies, where v=x.

The circuits 53 and 51 transform the signal wr into $Was=f\cdot Sx$ (see FIG. 3) and, respectively, into $z=g\cdot x$ (see FIG. 2), wherein f and g are parameters to be determined experimentally.

From the above there is obtained $$Vas=f\cdot 0.5\cdot(t+\sin t)-wa+g\cdot 0.25\cdot(1+\cos t)^2$$

and since in case of $t+\Delta t=\pi+\Delta t$, on the one hand $1+\cos t\cong 0$ and on the other hand, $\sin t\cong-\Delta t$, there is obtained for $t\cong\pi$ $$Vas=0.5\cdot f\cdot(\pi+\Delta t-\Delta t)-wa.$$

This means that for $2\cdot wa=f\cdot\pi$ the desired velocity of the sheet is zero at the motor 41.

Figure 6:
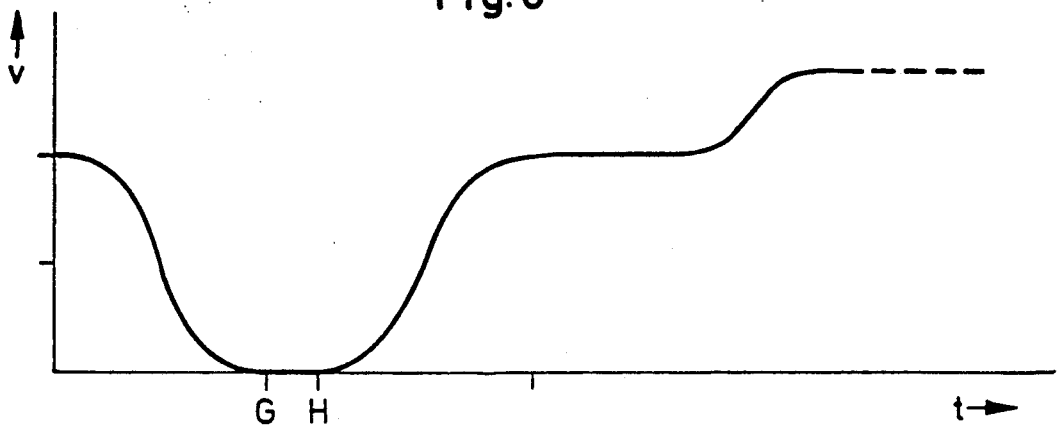
FIG. 6 is a diagram illustrating a second variant of the speed/time curve of a motor forming part of a circuit shown in FIG. 5.

FIG. 6 illustrates that the function v(t) may be determined by estimation and the velocity v may be maintained at a zero value for a predetermined period GH.

Figure 7:
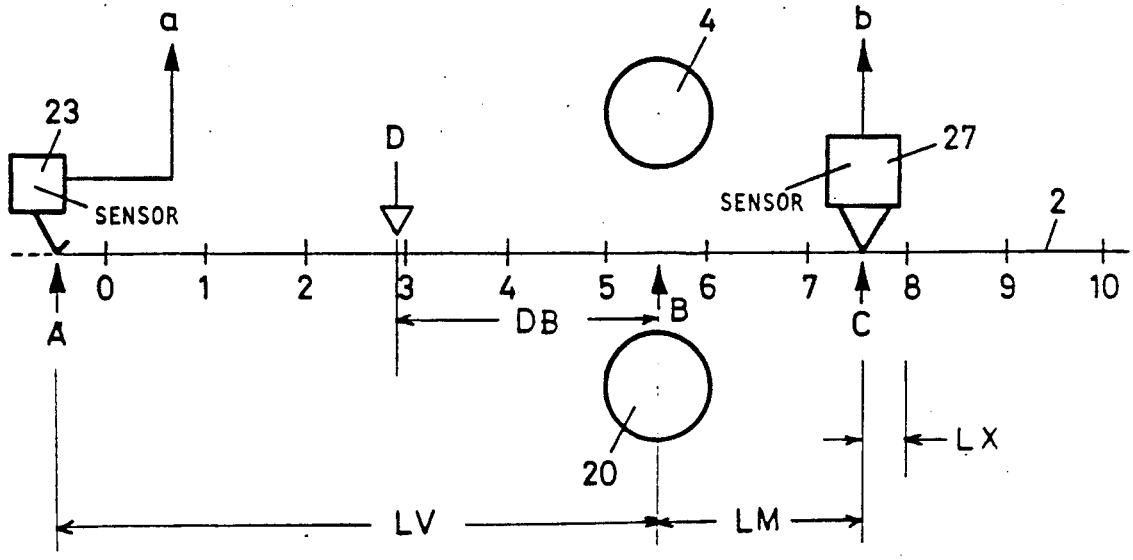
FIG. 7 is a diagram illustrating the operation of the apparatus according to the invention for observing a predetermined marking distance at the splicing location of the sheets.

In FIG. 7 the elements 2, 4, 20, 23 and 27 are symbolically illustrated to show their position relative to one another and to markings 1 through 10 of the sheet 2. The distance LV between the sensor point A of the sheet sensor 23 and the splicing location B between the splicing rollers 4 and 20 as well as the distance LM between the location B and the sensor point C of the sensor 27 is determined in each instance by the geometry of the system. The sensor 23 therefore recognizes the sheet end at the point A and accordingly delivers a signal a. The sensor 27 monitors continuously the markings and in each instance generates a signal b when a marking passes by. With the aid of the signals a and b the computer determines the distance LX between the marking 8 and the point C when the end of the sheet 2 is situated in point A. The computer also calculates the path length $$x=LX+LV+LM-LR$$

wherein LR is a safety addendum which takes into account the case when the sheet 2 has a tear at its end. In such a case the addendum LR is estimated, for example, it is selected to be smaller than the distance between markings.

The computer first determines the number of the whole marking spaces along the thus-defined length x with which the momentary position of the marking 1 is obtained. The computer then calculates the number of the markings up to the beginning of the velocity reduction as well as the corresponding phase shift of the motor 41 which is obtained with the aid of the signal va (FIG. 1) as well as the number of markings up to the moment of splicing and corresponding phase shift of the motor 41. In the example according to FIG. 7 there are obtained two markings 6 and 7 up to the beginning of the velocity reduction and two whole markings 4 and 5 up to the beginning of the splicing period. In FIG. 7 the distance DB corresponds, for example, 2[ times the marking distances, and the velocity reduction begins when the marking 1 passes the point D. The moment of splicing at which the end of the new sheet 18 (FIG. 1) is connected with the incoming end of the old sheet 2, corresponds to the passage of the marking 1 at the point B at which the velocity of the sheet is zero for a moment.

It is an advantage of the process according to the invention that for different formats only a single reference location is required. Further, the process provides a defined, controlled lowering motion of the advancing sheet which makes possible an accurately centered splicing even at machine outputs.

The splicing according to the process may also be set in such a manner that the take-off length is determined by ascertaining the distance between two centering marks which, for example, may be performed by virtue of the cooperation of an optical sensor and an incremental transmitter, wherein one pull-off length corresponds to the distance between two centering marks.

It is further to be noted that one or both motors 31, 41 may be d.c. servomotors with tachogenerator and incremental transmitter or a.c. servomotors (for example, with resolvers) which are highly dynamic and deliver a signal representing the absolute angle. It is to be understood that other drives may also be used. In this connection the fact has to be taken into account that the integration which is performed by the integrator 49 of the equivalency circuit illustrated in FIG. 4 and a subtraction which is performed by the subtracter 48 are in practice performed at the device 22.

It will be understood that the above description of the present invention is susceptible to various modifications, changes and adaptations, and the same are intended to be comprehended within the meaning and range of equivalents of the appended claims.

What is claimed is:

1. A method of splicing a trailing end of a first sheet to a leading end of a second sheet, comprising the following steps:

(a) causing engagement of the first sheet by a first rotary drive of a first servomechanism and by a second rotary drive of a second servomechanism;

(b) advancing the first sheet in a direction of advance by said first rotary drive and said second rotary drive; said second rotary drive being situated upstream of said first rotary drive as viewed in the direction of advance;

(c) generating a signal a when the trailing end of the first sheet passes a predetermined location and applying the signal a to a computer;

(d) based on signal a, generating a particular signal Vas by the computer and applying the particular signal Vas to said second servomechanism for reducing the advancing speed of the first sheet to zero at a given moment thereby facilitating said splicing; said step of generating said particular signal Vas comprises the steps of (1) generating, by a first correcting circuit of an equivalence circuit of the computer, an output signal z;

(2) generating, by a second correcting circuit of said equivalence circuit of the computer, an output signal Was separately from step (d)(1);

(3) applying the output signal z to a first input of a multiplier of the equivalence circuit;

(4) applying the output signal Was to a first input of a subtractor of the equivalence circuit;

(5) applying an output signal v of the first servomechanism to a second input of said multiplier; said output signal v representing an actual speed of the first sheet at said first rotary drive;

(6) forming, by said multiplier, an output signal V'as from the output signals v and z;

(7) applying the output signal V'as to a first input of an adder of the equivalence circuit;

(8) forming, by said adder, said particular signal Vas by summing the output signal V'as and an output signal da of the subtracter applied to a second input of said adder;

(9) applying an output signal wr of the first servomechanism to an input of said first correcting circuit and to an input of said second correcting circuit; said output signal wr representing an actual angular position of said first rotary drive; and

(10) applying an output signal wa of the second servomechanism to a second input of said subtracter; said output signal wa representing an actual angular position of said second rotary drive;

(e) splicing said trailing end to said leading end at a location upstream of said second rotary drive while said trailing end is stationary as a result of step (d), and (f) after step (e), generating a normal signal Vas by the computer and applying the normal signal Vas to said second servomechanism for normally advancing said first sheet.

2. A method as defined in claim 1, further wherein the normal signal Vas equals $v+p\cdot Whs-q\cdot\int(va-v)dt$, t is a time period, Whs is a desired length increase of the first sheet between said first and second rotary drives during said time period, va is the advancing speed of the first sheet imparted thereon by said second drive and p and q are parameters.

3. A method as defined in claim 1, further wherein the particular signal Vas equals $f\cdot\int v\cdot dt-wa+g\cdot v^2$, where $v=0$ during the performance of step (e), and f and g are parameters.

4. A method as defined in claim 1, wherein said output signal Was is represented by a sheet displacement-/time curve having an inflexion point of zero slope.

5. A method as defined in claim 1, wherein said output signal z is represented by a sheet velocity/time curve having a minimum value equalling zero velocity.

* * * * *